United States Patent [19]

Trzeciak et al.

[11] Patent Number: 4,729,675

[45] Date of Patent: Mar. 8, 1988

[54] DOWNHOLE MOTOR AND BEARING ASSEMBLY

[75] Inventors: Kurt Trzeciak; William C. Maurer, both of Houston, Tex.

[73] Assignee: Magna Tools, Inc., Houston, Tex.

[21] Appl. No.: 49,672

[22] Filed: May 13, 1987

Related U.S. Application Data

[63] Continuation of Ser. No. 693,144, Jan. 22, 1985, abandoned, which is a continuation of Ser. No. 572,856, Jan. 22, 1984, abandoned.

[51] Int. Cl.[4] ..... E21B 4/00; F16C 19/02; F16C 19/10; F16C 19/52

[52] U.S. Cl. ..... 384/613; 384/126; 384/624; 175/107

[58] Field of Search ..... 384/91, 93, 126, 452, 384/455, 512, 535, 592, 593, 613, 611, 624, 609; 175/107; 415/502

[56] References Cited

U.S. PATENT DOCUMENTS

| | | | |
|---|---|---|---|
| 3,449,030 | 6/1969 | Tirapolsky | 384/611 |
| 3,594,106 | 7/1971 | Garrison | 415/502 |
| 3,666,330 | 5/1972 | Dicky | 384/126 |
| 3,879,094 | 4/1975 | Tscirky et al. | 384/91 X |
| 4,135,772 | 1/1979 | Stodt | 384/613 |
| 4,260,202 | 4/1981 | Crase et al. | 384/93 |
| 4,388,973 | 6/1983 | Winkelmann et al. | 175/107 X |

*Primary Examiner*—Stuart S. Levy
*Assistant Examiner*—Lynn M. Sohacki
*Attorney, Agent, or Firm*—Fishman & Dionne

[57] ABSTRACT

A downhole motor and bearing assembly has a tubular housing with an inlet and outlet for flow of drilling fluid. A stator is supported in the housing and a rotor is supported for rotary movement in the stator. An open tubular shaft is connected to the rotor for rotary movement in the housing. The bearing assembly has bearing members in the housing in fixed spaced relation and other bearing members cooperable therewith. Sleeve members positioned in the housing support selected bearing members in a fixed spaced relation. Other sleeve members positioned on the shaft support the other bearing members in a fixed spaced relation. The sleeve members are interchangeably positioned in the housing and on the shaft to position the bearing members in selected interchangeable relation according to the need for the bearings to support a load in a forward or reverse direction. A radial sleeve bearing is supported in the housing in a bearing relation to the shaft in a position forward and backward of the bearing assembly. The housing and bearing assembly are open at the rear end for flow of drilling fluid therethrough.

32 Claims, 8 Drawing Figures

DOWNHOLE MOTOR AND BEARING ASSEMBLY

This application is a continuation of application Ser. No. 693,144, filed Jan. 22, 1985, now abandoned, which in turn is a continuation of U.S. Ser. No. 572,856, filed Jan. 22, 1984, now abandoned.

BACKGROUND OF THE INVENTION

1. Field of the Invention

This invention relates to new and useful improvements in downhole motors and more particularly to bearing assemblies for use on downhole motors.

2. Brief Description of the Prior Art

Drilling apparatus wherein a drill bit is operated by a downhole motor, such as positive displacement fluid motors or a turbine driven motors, are well known in the prior art. In such motors, the drill bit is rotated by a rotor being turned by flow of fluid, such as drilling fluid through the motor assembly.

In such downhole motor assemblies, bearings are provided which are sometimes part of the overall motor assembly and which are sometimes provided in a separate bearing pack or bearing assembly which is fastened or secured to the motor housing. The bearings support the drilling thrust on the shaft during the drilling operation. Other bearings transfer hydraulic thrust from the motor to the shaft when the motor is pulled from the bore hole or when the drill bit is lifted off bottom.

Bearings assemblies are usually provided with springs to absorb axial shock loading during drilling. In most bearing assemblies, there are provided both axial thrust bearings and radial bearings. The thrust bearings may have to carry varying amounts of axial thrust depending upon the weight applied to the bit during the drilling operation. In some cases there is need to support a substantial amount of upward thrust. In other cases, more or less of equal amounts of upward and downward thrust need to be supported. In still other cases, there is a need for supporting downward thrust loads.

Tschirky U.S. Pat. No. 3,879,094 discloses a downhole motor consisting of a positive displacement motor having a bearing assembly on the motor housing which has tungsten carbide radial bearings and a plurality of longitudinally spaced axial thrust bearings.

Tiraspolsky U.S. Pat. No. 3,449,030 discloses a bearing assembly for use in downhole motors which includes a plurality of spaced axial thrust bearings having woven wire annular pads which function to absorb shock.

Garrison U.S. Pat. No. 3,594,106 discloses a downhole motor assembly having a plurality of longitudinally spaced axial thrust bearings and a spring mechanism for absorbing shock.

Stodt U.S. Pat. No. 4,135,772 discloses a bearing assembly for a downhole motor driven drill having axially spaced ball bearings for carrying axial thrust loads and having springs interposed between the bearings for absorbing shock.

Crase U.S. Pat. No. 4,260,202 discloses a bearing assembly for downhole motors which includes spaced ball bearing assemblies which include springs for absorbing axial shock.

Winkelmann U.S. Pat. No. 4,388,973 discloses a bearing assembly for a downhole motor in which bearings are spaced by shoulders on a series of sleeves which form a continuous supporting tube on the inside and outside of the bearing structure and supported on the rotating motor shaft. These bearings include springs for absorbing axial shock loads but are not constructed for interchangeability of the positioning of the bearings for determining the amount of upward and downward thrust supported by the bearing assembly.

SUMMARY OF THE INVENTION

It is therefore one object of this invention to provide a new and improved bearing assembly for use in combination with downhole motors for earth drilling.

Another object of this invention is to provide a new and improved bearing assembly for use in combination with downhole motors having means for changing a bearing loading according to the amount of upward or downward thrust encountered in the drilling operation.

Another object of this invention is to provide a new and improved bearing assembly which consist of stacked bearings supported by interchangeable bearing sleeve members to vary the relationship of the bearings for supporting the thrust loads in the upward and in the downward direction.

Still another object of this invention is to provide a bearing assembly for use in connection with downhole motors wherein the bearings are spaced by a plurality of sleeve members which locate the bearings in selected positions and wherein the bearings may be changed by relocating the supporting sleeves and the particular bearing sub-assemblies to vary the upward and downward thrust loads carried by the bearing assembly.

Other objects of this invention will come apparent from time to time throughout the specification and claims as hereinafter related.

The above stated objects and other objects of the invention are accomplished by a downhole motor and bearing assembly which has a tubular housing with an inlet and outlet for flow of drilling fluid, a stator supported in the housing and a rotor supported for rotary movement in the stator. An open tubular shaft is connected to the rotor for rotary movement in the housing. The bearing assembly has bearing members in the housing in fixed spaced relation and other bearing members cooperable therewith. Sleeve members positioned in the housing support selected bearing members in a fixed spaced relation. Other sleeve members positioned on the shaft support the other bearing members in a fixed spaced relation. The sleeve members are interchangeably positioned in the housing and on the shaft to position the bearing members in selected interchangeable relation according to the need for the bearings to support a load in a forward or reverse direction. A radial sleeve bearing is supported in the housing in bearing relation to the shaft in a position forward and backward of the bearing assembly. The housing and bearing assembly are open at the rear end for flow of drilling fluid therethrough.

DESCRIPTION OF THE PREFERRED EMBODIMENT

Figure 1:
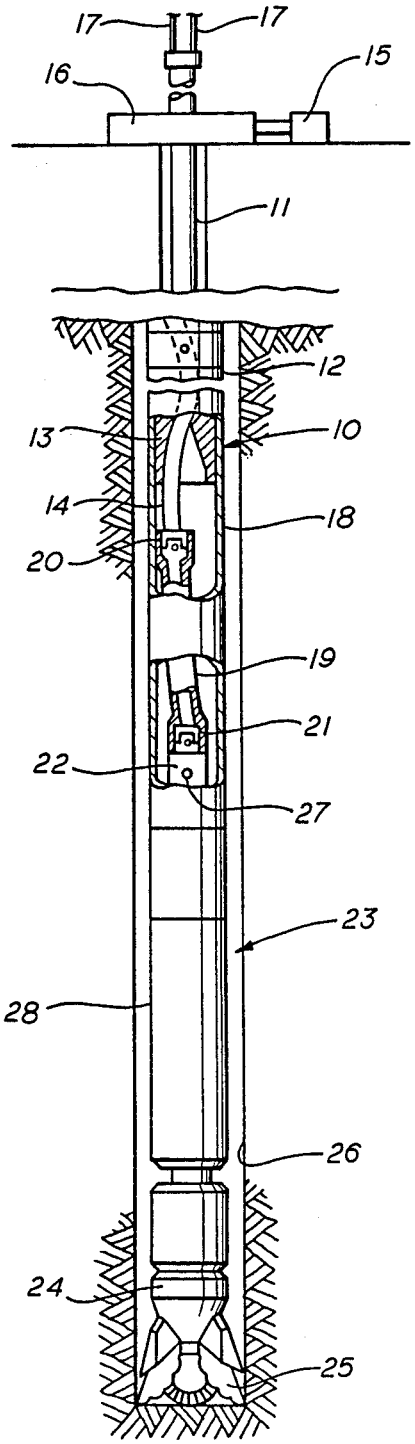
FIG. 1 is a view diagrammatically showing a downhole motor and bearing assembly for earth drilling which is partially in section and incorporating a bearing structure illustrating a preferred embodiment of this invention.

Referring to the drawings by numerals of reference, and more particularly to FIG. 1, there is shown a downhole motor assembly 10 which is connected to the lower end of a string of drill pipe 11 which conducts drilling fluid through the motor assembly and into the bore hole. Motor assembly 10 has a housing 12 in which there is secured a hollow, fixed stator 13.

In the embodiment shown in FIG. 1, motor assembly 10 is a positive displacement motor such as a Moineau type fluid motor having a helicoid progressing cavity. A rotatable helicoidal rotor 14 is positioned in stator 13 and rotated in response to drilling fluid flowing through the stator. As noted, the motor which is illustrated is a positive displacement fluid motor of a well known commercially available type. Obviously, other types of fluid operated motors can be used, especially fluid turbine operated motors, sometimes known as turbodrills. The rotor is driven by the downward flow of drilling fluid which is supplied to the drill pipe 11 by a pump 15. Pump 15 is located on a conventional drilling rig having a rotary table 16 which rotates pipe 11 in the drill hole. Pipe 11 is supported by drilling lines 17 of the drill rig.

The drilling fluid flows through the apparatus in a downward direction through a connecting rod housing section 18. Connecting rod housing section 18 encloses connecting rod assembly 19 which is connected by a first universal joint 20 to the lower end of rotor 14 and by a second universal joint 21 to the upper end of a drive shaft 22.

The drive shaft 22 extends downwardly through and is rotatably supported in a bearing assembly 23. Drive shaft 22 is hollow in construction, as will be subsequently described, and has a drill bit 24 at its lower end which may have conventional rolling cutters 25 for drilling through an earth formation to form a bore hole 26. Drill bit 25 is shown as having rotary cutters of the milled tooth type, but rotary cutters having hard metal compacts or inserts can also be used. Also, in many applications, rotary bits of the diamond insert type are used which can be rotated at relatively high speed without excessive damage or wear.

The drill shaft 22 is tubular in shape and has inlet ports 27 at its upper, end. The drilling fluid passes from the connecting rod housing 18 through the inlet ports 27 into the elongated central bore of the drive shaft. The fluid passing through the drive shaft exits from the drill bit 24 to flush cuttings from the bore hole 26 and to further cool the bit.

During operation of the fluid motor 10, the lower end of rotor 14 has an eccentric motion which is transmitted to drive shaft 22 by the universal connecting rod assembly 19. Drive shaft 22 therefore revolves about a fixed axis within the outer housing structure 28 of the bearing assembly 23. The drive shaft 22 is supported within the housing by bearing means, which is described below and shown more fully in FIGS. 2A, 2B, and 2C, which constitutes a major novel feature of the preferred embodiment of the invention.

Figure 2A:
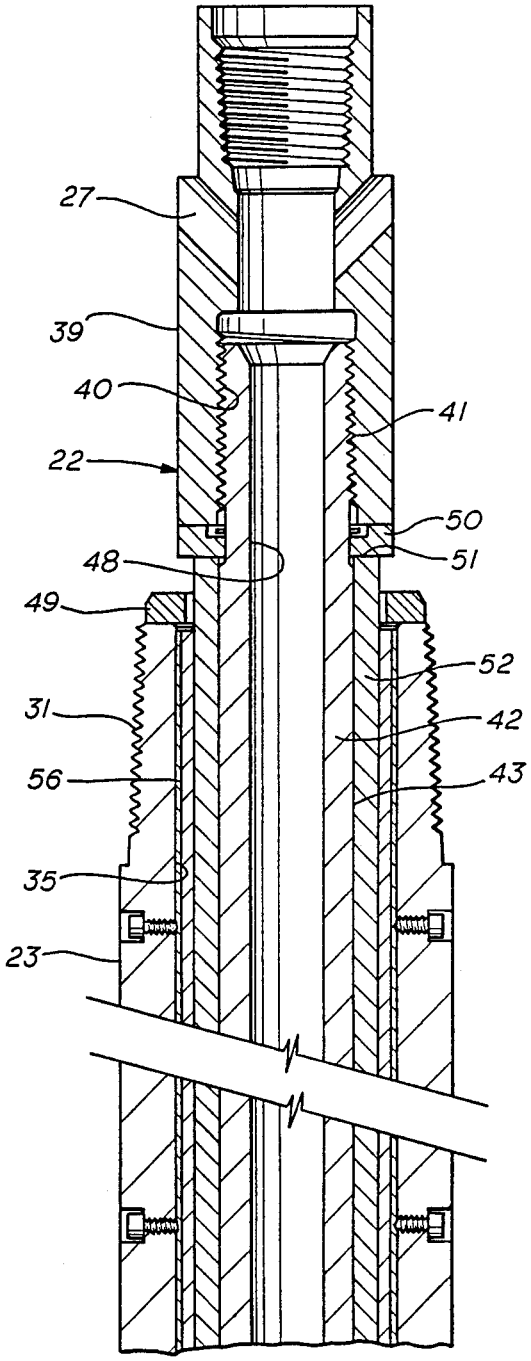
FIGS. 2A, 2B, and 2C, taken together constitute an enlarged longitudinal sectional view showing details of the bearing assembly and its relation to the rotary shaft which carries the drill bit.

In FIG. 2A, it is seen that bearing housing 23 is threaded as indicated at 31 for connection to the lower end of motor housing or connection rod housing 18. The lower end of bearing housing 23 is internally threaded as indicated at 32 (see FIG. 2B) for connection to the threaded upper end 33 of bearing pack housing sub 34. Bearing housing 23 and bearing pack housing sub 34 are threadedly connected together to form a tight continuous tubular housing separable at the threaded joint formed of threads 32 and 33.

Figure 2B:
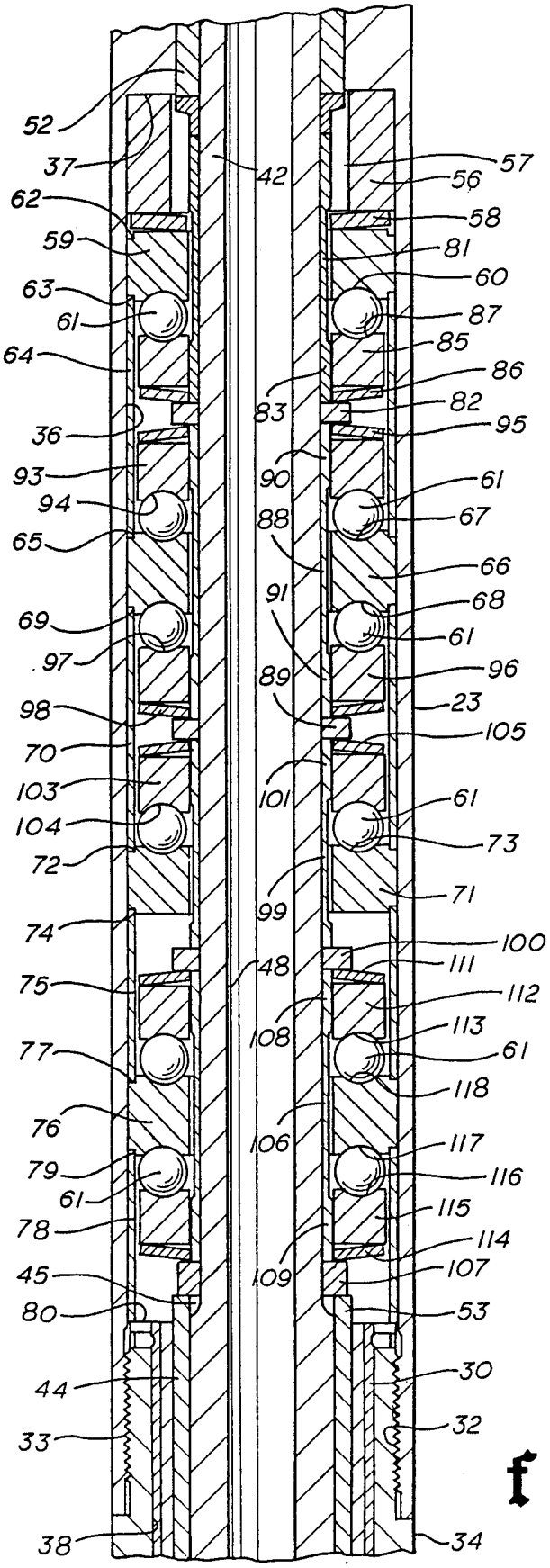
Figure 2C:
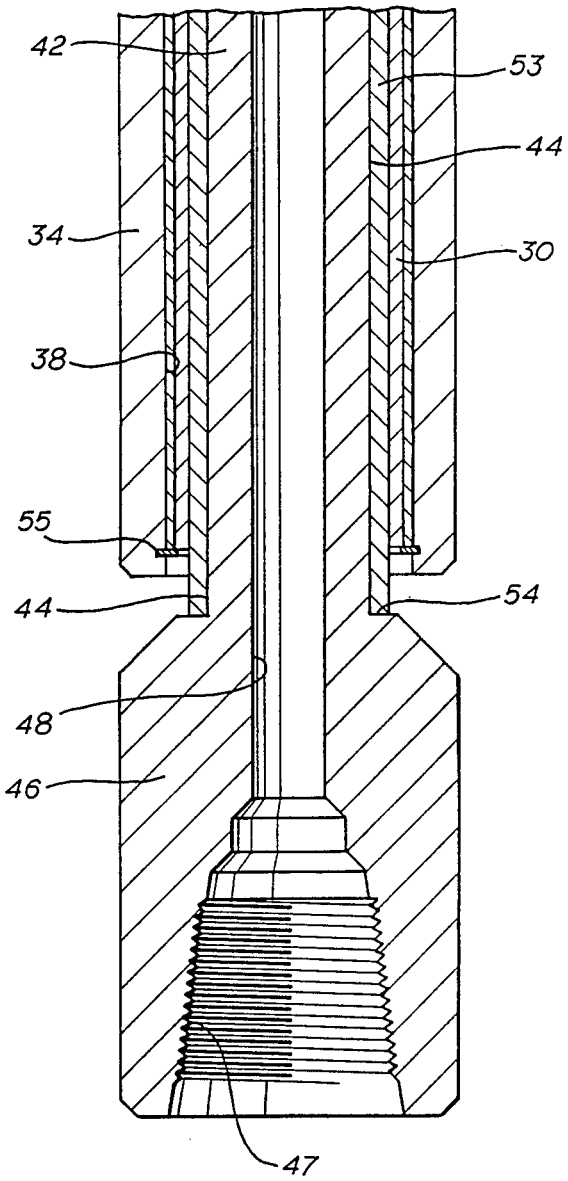

Bearing housing 23 has an integral cylindrical bore 35 extending from the upper or rear end portion toward the lower or forward portion thereof and opening into an enlarged bore 36. Bores 35 and 36 define a downwardly facing shoulder 37 in housing 23. Bearing pack housing sub 34 has an internal bore 38 extending from end to end thereof. As seen in FIGS. 2A–2C, drive shaft 22 extends through the hollow interior of bearing housing 23 and bearing housing sub 34.

Drive shaft 22 includes drive shaft cap 39 which is interiorly threaded as indicated at 40 and threadedly secured on the threaded upper end 41 of tubular shaft member 42. Tubular shaft member 42 has a smaller upper end portion 43 and an enlarged lower end portion 44 joined by a curved shoulder portion 45. An enlarged end portion of drive shaft 22 consists of an enlarged sub portion 46 having an interiorly threaded open end portion 47 which is threadedly connected to threaded connecting sub (not shown) of drill bit 24.

A cylindrical passage or bore 48 extends for the entire length of drill shaft 22 and opens through the lower end portion thereof through drill bit connecting sub portion 46 into drill bit 24 for discharge of drilling fluid through the drill bit to flush cuttings from the bore hole and cool the cutting surfaces of the drill bit. The normal operation of the downhole motor involves a flow of fluid through the motor which causes the drive shaft to be rotated and through the center bore 48 of the drive shaft and around the exterior of the drive shaft through the sleeve bearings and the bearing assembly. Drive shaft member 22 is supported on an assembly of bearing members which are described further below. Retaining ring 49 is positioned against the upper threaded end portion 31 of bearing housing 23. Drive shaft retaining ring 50 is secured between the drive shaft cap 39 and the upper end portion 51 of sleeve member 52 which is a wear sleeve secured on drive shaft member 42.

The lower end of wear sleeve 52 supports part of the bearing assembly as will be subsequently described. A lower wear sleeve 53 surrounds the lower enlarged portion 42 of the drive shaft 22 and abuts the upper shoulder 54 on the drill bit connection sub portion 46 of the drive shaft. A lower radial sleeve bearing 30 surrounds lower bearing wear sleeve 53 and is secured in place by snap ring 55 at the lower end of housing 34. An upper radial sleeve bearing 56 surrounds upper wear sleeve 52 and extends from the retaining ring 49 to thrust bearing shoulder ring 56.

At the upper end of the bearing assembly (FIG. 2B) an upset spacer ring 57 is positioned on the shaft member 42 for rotation therewith. Spacer ring 57 is positioned inside and spaced from shoulder ring 56 with sufficient clearance for flow of drilling fluid through the bearings. Immediately below shoulder ring 56, there is positioned a Belleville spring 58 which abuts the upper surface of the stationary bearing race member 59.

Bearing race member 59 is a single sided race member having a ball-receiving race 60 in the lower face receiving a plurality of ball bearing members 61. Bearing race member 59 is positioned inside housing 23 as a stationary race. Bearing race member 59 has an upper peripheral shoulder 62 and a lower peripheral 63 for receiving supporting sleeves wherever the race may be positioned in the bearing assembly.

The lower peripheral shoulder 63 on bearing race member 59 abuts a long sleeve member 64 which extends to the upper shoulder 65 on a double sided race member 66. Bearing race member 66 has an upper bearing receiving race 67 and a lower bearing receiving race 68 which receives bearings 61. Double bearing race 66 has a peripheral shoulder portion 69 at its lower end which fits a long sleeve member 70 which is positioned as a stationary spacer sleeve in housing 23.

The lower end of sleeve 70 abuts a single sided bearing race member 71 in an upper peripheral shoulder 72 thereon. Bearing race member 71 has a single bearing race 73 which receives ball bearing member 61. Bearing race member 71 has a lower shoulder 74 which receives the upper end of a short spacer sleeve 75 which is positioned in a stationary location inside bearing housing 23.

The lower end of sleeve member 75 abuts double sided race member 76 at a shoulder portion 77 on the upper end thereof. Short spacer sleeve 78 abuts shoulder portion 79 on double sided race 76 and abuts the upper end 80 of bearing housing sub 34. The stationary bearing race members 59, 66, 71, and 76 are held in a fixed position between the upper end 80 of bearing housing sub 34 and the spacer ring 56 at the upper end of the bearing pack.

The various bearing race members which are stationary with housing 23 have a radial depth inwardly which stops short of the supporting sleeves on the drive shaft. Belleville spring 58 compresses the various ball bearing race members toward each other with spacer sleeves 64, 70, 75, and 78 fixing the bearing races in selected positions.

The rotating bearings, i.e. bearing race members which rotate with the rotating shaft member 42 are supported on a system of spacer sleeves similar to the arrangement of sleeves supporting the fixed or stationary bearing race members. A short stationary bearing sleeve 81 is positioned between spacer ring 57 and supporting thrust washer 82. Spacer sleeve 81 is sized to provide a small clearance from the inner surface of upper bearing race member 59. There is sufficient clearance so that it does not contact or interfere with bearing race member 59 or Belleville spring 58.

Single sided bearing race member 85 is supported on the end portion 83 of spacer sleeve 81 for rotation with bearing drive shaft member 42. Bearing race member 85 has a bearing race 87 in the upper surface thereof. A Belleville spring 86 is supported on spacer ring 82 and biases the rotating bearing race member 85 against ball bearings 61. Bearings 61 in the upper bearing portion are therefore supported between race 87 in the upper surface of rotary bearing race member 85 and the bearing race 60 in stationary bearing race member 59.

A long spacer sleeve 88 is positioned on shaft member 42 for rotation therewith and extends from spacer ring 82 to the next lower spacer ring 89. Sleeve 88 is sized to provide a clearance from the inner surface of double sided bearing race member 66. An upper rotary bearing race member 93 having a bearing race portion 94 is positioned on end portion 90 of spacer sleeve 88 and urged into bearing relation with ball bearings 61 by Belleville spring 95. A lower single sided bearing race member 96 with a bearing race 97 is urged against the lower bearings 61 by Belleville spring 98 which is supported on spacer ring 89.

A short spacer ring 99 extends from spacer ring 89 to spacer ring 100 on shaft member 42 and is rotatable therewith. Spacer sleeve 99 is sized to provide a clearance from the inner surface of single sided stationary bearing race member 71. A single sided bearing race member 103 having a bearing race 104 is urged against ball bearings 61 by Belleville spring 105 which is supported against the underside of spacer ring 89. The lower end of spacer sleeve 99 abuts spacer ring 100.

A long spacer sleeve 106 extends from spacer ring 100 to lower spacer ring 107. Spacer sleeve 106 is sized to provide a clearance from the inner surface of stationary double sided bearing race member 76. An upper Belleville spring member 111 is positioned against underside of spacer ring 100 and abuts bearing race member 112 which is positioned on the end portion 108 of spacer sleeve 106. Bearing race member 112 is a single sided member with a bearing race 113 which is urged by Belleville spring 111 against ball bearing members 61. A lower Belleville spring 114 is positioned on spacer ring 107 and abuts the underside of rotating bearing race member 115. Bearing race member 115 is supported on the end portion 109 of spacer sleeve 106 and has a bearing race 116 in its upper surface which supports ball bearing members 61.

In the embodiment of the invention shown in FIGS. 2A–2C, shaft member 42 rotates in housings 34 and 23 with the upper sleeve bearing 56 and lower sleeve bearing 30 supporting the shaft against radial shaft loads. The system of ball bearings shown in FIG. 2B provides for supporting the shaft against vertical thrust loads in either an upward or downward direction.

In the embodiment of FIG. 2B, bearing race members 59, 66, 71, and 76 are fixed in a stationary position inside housing 23 and spaced in a preselected arrangement by sleeve members 64, 70, 75, and 78. The rotary bearing race members 85, 93, 96, 103, 112, and 115 are supported for rotation with shaft member 42 and support ball bearings 61 against the respective stationary ball bearing race members.

The ball bearing race members which rotate with shaft 42 are spaced in a predetermined desired position by sleeve members 81, 88, 99, and 106. In the embodiment shown in FIG. 2B the bearing, consisting of stationary race member 59, rotatable race 85 and ball bearings 61 positioned therebetween, supports shaft 42 against upward thrust load. The bearing, formed by rotary race member 96 and the lower bearing race 68 of race member 66 and bearings 61 positioned therebetween, likewise supports shaft member against vertical, upward thrust loads. The bearing, formed by rotary bearing race member 115 and ball bearings 61 bearing against the lower bearing race 117 of stationary bearing race member 76 also supports shaft 42 against upward thrust loads.

The bearing formed by the upper bearing race 67 of stationary bearing race member 66, ball bearings 61 and rotary bearing race member 93 supports shaft member 42 against downward thrust loads, as where the motor assembly is lifted off the bottom. Rotary bearing race member 103, ball bearings 61 and stationary bearing race member 71 provide a bearing supporting shaft member 42 against downward thrust loads. Rotary bearing race member 112 and ball bearings 61 resting on the upper bearing race 118 on stationary bearing race member 76 similarly support shaft member 42 against downward thrust loads as encountered when the motor is lifted off the bottom. In the embodiment of FIG. 2B, it is seen that the arrangement of spacers both for the fixed bearing races and the rotatable bearing races and the arrangement of the fixed and rotatable bearing races and ball bearings provides three bearings supporting upward thrust and three bearings supporting downward thrust loads.

The bearing arrangement for the ball bearings which support against upward and downward thrust loads can be rearranged according to the spacing of the spacer sleeves and the location of the stationary and rotating bearing members so that the number of bearings supporting upward and downward thrust loads can be varied. While the bearing arrangement in this invention is shown with six sets of ball bearings, any number of bearing sets can be used. Roller bearings could also be used if desired).

The arrangement of the bearings can be varied so that all of the bearings support an upward thrust load, or all support a downward thrust load. They may also be rearranged so that five bearings support an upward thrust load and one supports a downward thrust load or five support a downward thrust load and one supports an upward thrust load. Likewise, the arrangement of bearings may be rearranged so that two bearings support an upward thrust load and four support downward thrust loads or four support an upward thrust loads and two support downward thrust loads.

Examples of these variations in bearing assemblies are shown in FIGS. 3–6 of the drawings. The variation in number of bearings supporting upward or downward thrust is particularly useful when formation of different hardness are encountered or where varying downward thrust loads occur on lifting the drilling motor off bottom In FIG. 3, the various bearings have been rearranged so that two of the bearings carry upward loads and four of the bearings carry downward loads. In this arrangement, the upper races on stationary bearings member 59, 76, 71, and 66 carry downward loads. The lower races on bearing race members 112 and 66 carry upward loads.

Figures 3, 4, 5, 6:
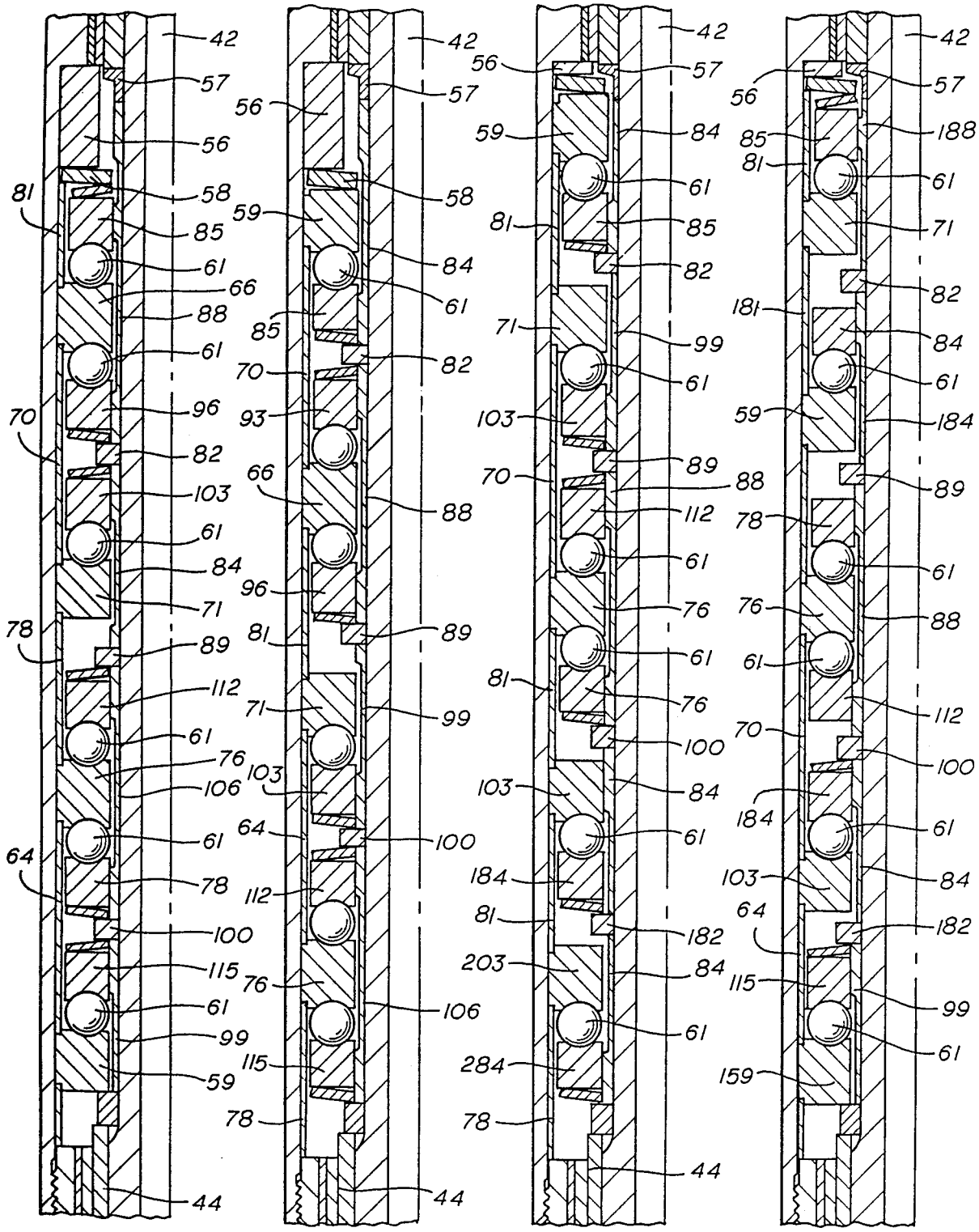
FIG. 3 is a quarter section, similar to FIG. 2B, showing the bearings arranged so that two bearings carry an upward load and four bearings carry a downward load.
FIG. 4 is a quarter section, similar to FIG. 2B, showing the bearings arranged so that four bearings carry an upward load and two bearings carry a downward load.
FIG. 5 is a quarter section, similar to FIG. 2B, showing the bearings arranged so that five bearings carry an upward load and one bearing carries a downward load.
FIG. 6 is a quarter section, similar to FIG. 2B, showing the bearing arranged so that one bearing carries an upward load and five bearings carry a downward load.

In FIG. 4, the bearings have been further rearranged so that four of the bearings carry upward loads and two carry downward loads. In this rearrangement of the bearings and spacer sleeves separating the bearings, the bottom race on bearing race members 76, 71, 66 and member 59 carry upward loads. The upper races on stationary bearing race members 66 and 76 carry downward loads.

In FIG. 5, there is shown a configuration of bearings in which five of the bearings carry upward loads and only one bearing carries a downward load. In this arrangement of loads, the bottom races of bearing race members 59, 71, 76, 103, and 203 (a bearing race member having the same structure as bearing race member 103) carry upward loads. The upper race of bearing race member 76 carries a downward load.

FIG. 6 illustrates a further rearrangement of a bearing member and the spacer sleeve which separate those members and fix them in position in which five of the bearings support downward loads while one bearing supports an upward load. In FIG. 6, the bottom race of double race member 76 carries an upward load while the top races of bearing race members 71, member 59, 76, 103 and 159 carry downward loads. A further rearrangement of the bearings can easily be made in which all of the bearings carry an upward load or all of the bearings carry a downward load.

The bearing pack described above is quite versatile in operation and may be rearranged in the field, if necessary, so that the number location of bearings carrying an upward load or downward load may be rearranged according to the requirements of the particular field conditions.

A function and advantage of the bearing structure of the present invention relates to operation in the case of ball failure. In the usual prior are bearing structure where the races are both fixed to their supporting structures, failure of the balls will result in seizure of the bearing. However the bearings of the present invention do not seize upon ball failure. If the balls of a particular bearing assembly (i.e., inner race, outer race and balls) fail, the inner race (which normally rotates with the shaft) will lock to the stationary outer race through the failed balls. However, since the inner race is not physically locked to the shaft, the now locked inner race will move relative to the shaft with axial force being applied by the adjacent Belleville spring; and the inner race will form, in effect, a friction bearing.

While this invention has been described fully and completely with special emphasis upon several preferred embodiments it should be understood that within the scope of the appended claims the invention may be practiced otherwise than as specifically described herein.

We claim:

1. A downhole motor and bearing assembly comprising:

a tubular housing having an inlet and an outlet for flow of fluid therethrough, a stator supported in a fixed position in said housing, a rotor supported for rotary movement in said stator, a shaft operatively connected to said rotor and supported for rotary movement in said housing, a bearing assembly comprising a first plurality of bearing members supported in said housing in fixed spaced relation therein, a second plurality of bearing members cooperable one with each of said first plurality of bearing members and operatively supported on said shaft in fixed spaced relation for rotation therewith, said second bearing members being normally rotatable with said shaft, but being capable of movement relative to said shaft, a first plurality of sleeve members positioned in said housing in spaced relation and operatively supporting said first plurlaity of bearing members in said fixed spaced relation, a second plurality of sleeve members positioned on said shaft in spaced relation and operatively supporting said second plurality of bearing members in said fixed spaced relation, and said sleeve members being interchangeably positioned in said housing and on said shaft to position said bearing members in selected interchangeable relations according to the need for bearings to support a load in a forward or reverse direction.

2. A downhole motor and bearing assembly according to claim 1 in which
said shaft is of open tubular construction permitting flow of fluid therethrough.

3. A downhole motor and bearing assembly according to claim 1 additionally including
a sleeve bearing supported in said housing in bearing relation to said shaft in a position forward of said bearing assembly.

4. A downhole motor and bearing assembly according to claim 1 in which
said shaft is of open tubular construction permitting flow of fluid therethrough, and additionally including
a sleeve bearing supported in said housing in bearing relation to said shaft in a position forward of said bearing assembly.

5. A downhole motor and bearing assembly according to claim 1 in which
said bearing assembly comprises a first plurality of bearing races supported in said housing in fixed spaced relation therein,
a second plurality of bearing races aligned one with each of said first plurality of bearing members and operatively supported on said shaft in fixed spaced relation for rotation therewith, and
roller bearing members positioned in bearing relation with said aligned bearing races.

6. A downhole motor and bearing assembly according to claim 5 in which
said bearing members are ball bearings.

7. A downhole motor and bearing assembly according to claim 5 in which
said first plurality of sleeve members are of at least two different lengths and positioned in said housing in selected fixed positions abutting selected ones of said first plurality of bearing races to establish a selected fixed spaced relation thereof,
said second plurality of sleeve members are of at least two different lengths and positioned on said shaft in selected fixed positions abutting selected ones of said second plurality of bearing races to establish a selected fixed spaced relation thereof, and
means supporting said sleeve members interchangeably in said housing and on said shaft to position said bearing races and said rolling bearing members in selected interchangeable relations according to the need for bearings to support a load in a forward or reverse direction.

8. A downhole motor and bearing assembly according to claim 5 in which
said first plurality of bearing races include a selected number of single sided races and a selected number of double sided races,
said first plurality of sleeve members are of at least two different lengths and positioned in said housing in selected fixed positions abutting selected ones of said first plurality of bearing races to establish a selected fixed spaced relation thereof,
said second plurality of bearing races being single sided races and positioned in alignment with said first bearing races,
said second plurality of sleeve members are of at least two different lengths and positioned on said shaft in selected fixed positions supporting selected ones of said second plurality of bearing races to establish a selected fixed spaced relation thereof,
supporting members supported by said second plurality of sleeve members including spring means resiliently supporting said second bearing races, and
means supporting said sleeve members interchangeably in said housing and on said shaft to position said bearing races and said rolling bearing members in selected interchangeable relations according to the need for bearings to support a load in a forward or reverse direction.

9. A downhole motor and bearing assembly according to claim 1 in which
said shaft is of open tubular construction permitting flow of fluid therethrough, and additionally including
a sleeve bearing supported in said housing in bearing relation to said shaft in a position forward of said bearing assembly, and
said housing and bearing assembly being open at the rearward end thereof to permit flow of fluid through said bearing assembly and said sleeve bearing.

10. A bearing assembly for assembly on a downhole motor comprising a tubular housing having an inlet and an outlet for flow of fluid therethrough, a stator supported in a fixed position in said housing, a rotor supported for rotary movement in said stator, said assembly comprising
a bearing housing adapted to be removably secured on said motor housing,
a shaft for supporting a drill bit and adapted to be connected to said rotor and supported for rotary movement in said bearing housing,
a bearing assembly comprising a first plurality of bearing members supported in said bearing housing in fixed spaced relation therein,
a second plurality of bearing member cooperable one with each of said first plurality of bearing members and operatively suported on said shaft in fixed spaced relation for rotation therewith, said second bearing members being normally rotatable with said shaft, but being capable of movement relative to said shaft,
a first plurality of sleeve members positioned in said bearing housing in spaced relation and operatively supporting said first plurality of bearing members in said fixed spaced relation,
a second plurality of sleeve members positioned on said shaft in spaced relation and operatively supporting said second plurality of bearing members in said fixed spaced relation, and said sleeve members being interchangeably positioned in said bearing housing and on said shaft to position said bearing members in selected interchangeable relation according to the need for bearings to support a load in a forward or reverse direction.

11. A bearing assembly according to claim 10 in which
said shaft is of open tubular construction permitting flow of fluid therethrough.

12. A bearing assembly according to claim 10 additionally including
a sleeve bearing supported in said housing in bearing relation to said shaft in a position forward of said bearing assembly.

13. A bearing assembly according to claim 10 in which said shaft is of open tubular construction permitting flow of fluid therethrough, and additionally including a sleeve bearing supported in said housing in bearing relation to said shaft in a position forward of said bearing assembly.

14. A bearing assembly according to claim 10 in which said bearing assembly comprises a first plurality of bearing races supported in said housing in fixed spaced relation therein, a second plurality of bearing races aligned one with each of said first plurality of bearing members and operatively supported on said shaft in fixed spaced relation for rotation therewith, and rolling bearing members positioned in bearing relation with said aligned bearing races.

15. A bearing assembly according to claim 14 in which said bearing members are ball bearings.

16. A bearing assembly according to claim 14 in which said first plurality of sleeve members are of at least two different lengths and positioned in said housing in selected fixed positions abutting selected ones of said first plurality of bearing races to establish a selected fixed spaced relation thereof, said second plurality of sleeve members are of at least two different lengths and positioned on said shaft in selected fixed positions abutting selected ones of said second plurality of bearing races to establish a selected fixed spaced relation thereof, and means supporting said sleeve members interchangeably in said housing and on said shaft to position said bearing races and said rolling bearing members in selected interchangeable relations according to the need for bearings to support a load in a forward or reverse direction.

17. A bearing assembly according to claim 14 in which said first plurality of bearing races include a selected number of single sided races and a selected number of double sided races, said first plurality of sleeve members are of at least two different lengths and positioned in said housing in selected fixed positions abutting selected ones of said first plurality of bearing races to establish a selected fixed spaced relation thereof, said second plurality of bearing races being single sided races and positioned in alignment with said first bearing races, said second plurality of sleeve members are of at least two different lengths and positioned on said shaft in selected fixed positions supporting selected ones of said second plurality of bearing races to establish a selected fixed spaced relation thereof, supporting members supported by said second plurality of sleeve members including spring means resiliently supporting said second bearing races, and means supporting said sleeve members interchangeably in said housing and on said shaft to position said bearing races and said rolling bearing members in selected interchangeable relations according to the need for bearings to support a load in a forward or reverse direction.

18. A bearing assembly according to claim 10 in which said shaft is of open tubular construction permitting flow of fluid therethrough, and additionally including a sleeve bearing supported in said housing in bearing relation to said shaft in a position forward of said bearing assembly, and said housing and bearing assembly being open at the rearward end thereof to permit flow of fluid through said bearing assembly and said sleeve bearing.

19. A downhole motor and bearing assembly comprising:

a tubular housing;

a rotatable shaft in said housing;

a bearing assembly comprising a first plurality of bearing members supported along said housing in a first fixed axially spaced relation therein;

a second plurality of bearing members cooperable one with each of said first plurality of bearing members and supported along said shaft in a second fixed axially spaced relation, said second bearing members being normally rotatable with said shaft, but capable of movement relative to said shaft;

a first plurality of sleeve member positioned along said housing in spaced relation and supporting said first plurality of bearing members in said first fixed axially spaced relation;

a second plurality of sleeve members positioned along said shaft in spaced relation and operatively supporting said second plurality of bearing members in said second fixed axially spaced relation; and said sleeve members being interchangeably positionable along said housing and along said shaft to position said bearing members in selected interchangeable relationships according to the need for bearings to support a load in first of second opposed axial directions.

20. A downhole motor and bearing assembly according to claim 19 wherein:

said bearing assembly comprises a first plurality of bearing races supported along said housing in a first fixed axially spaced relation therein;

a second plurality of bearing races aligned one with each of said first plurality of bearing members and supported along said shaft in a second fixed axially spaced relation, said second races being rotatable with said shaft; and rolling bearing members positioned in load bearing relation with said aligned baring races.

21. A downhole motor and bearing assembly according to claim 20 in which:

said bearing members are ball bearings.

22. A downhole motor and bearing assembly according to claim 20 wherein:

said first plurality of sleeve members are of at least two different lengths and are positioned in said housing in selected axially fixed positions abutting selected ones of said first plurality of bearing races to establish said first fixed spaced relation of said first races;

said second plurality of sleeve members are of at least two different lengths and are positioned along said shaft in selected axially fixed positions abuting selected ones of said second plurality of bearing races to establish said second fixed axially spaced relation of said second races; and means supporting said sleeve members along said housing and along said shaft.

23. A downhole motor and bearing assembly according to claim 20 wherein:

said first plurality of sleeve members are of at least two different lengths and are positioned along said housing in selected fixed axial positions abutting selected ones of said first plurality of bearing races to establich said first selected fixed axially spaced relation thereof;

said second plurality of bearing races are single sided races and are positioned in alignment with said first bearing races;

said second plurality of sleeve members are of at least two different lengths and are positioned along said shaft in selected fixed positions supporting selected ones of said second plurality of bearing races to establish said second selected fixed axially spaced relation thereof; and further including supporting means supported by said second plurality of sleeve members to resiliently support said second bearing race.

24. A bearing assembly for the rotary shaft of a downhole motor, said assembly comprising:

a bearing housing;

a bearing assembly comprising a first plurality of bearing members supported in said bearing housing in a first fixed axially spaced relation therein;

a second plurality of bearing members cooperable one with each of said first plurality of bearing members and supported along said shaft in fixed spaced relation, said second bearing members being normally rotatable with said shaft, but capable of movement relative to said shaft;

a first plurality of sleeve members positioned in said bearing housing in spaced axial relation and supporting said first plurality of bearing members in said first fixed axial spaced relation;

a second plurality of sleeve members positioned along said shaft in spaced relation and supporting said second plurality of bearing members in said second fixed axial spaced relation; and said sleeve members being interchangeably positionable in said bearing housing and along said shaft to position said bearing members in selected interchangeable relation according to the need for bearings to support a load in first and second opposed axial direction.

25. A bearing assembly according to claim 24 wherein:

said bearing assembly comprises a first plurality of bearing races supported along said housing in a first fixed axially spaced relation therein;

a second plurality of bearing races aligned one with each of said first plurality of bearing members and supported along said shaft in a second fixed axially spaced relation, said second races being rotatable with said shaft; and rolling bearing members positioned in load bearing relation with said aligned bearing races.

26. A bearing assembly according to claim 25 in which:

said bearing members are ball bearings.

27. A bearing assembly according to claim 25 wherein:

said first plurality of sleeve members are of at least two different lengths and are positioned in said housing in selected axially fixed positions abutting selected ones of said first plurality of bearing races to establish said first fixed spaced relation of said first races;

said second plurality of sleeve members are of at least two different lengths and are positioned along said shaft in selected axially fixed positions abutting selected ones of said second plurality of bearing races to establish said second fixed axially spaced relation of said second races; and means supporting said sleeve members along said housing and along said shaft.

28. A bearing assembly according to claim 25 wherein:

said first plurality of sleeve members are of at least two different lengths and are positioned along said housing in selected fixed axial positions abutting selected ones of said first plurality of bearing races to establish said first selected fixed axially spaced relation thereof;

said second plurality of bearing races are single sided races and are positioned in alignment with said first bearing races;

said second plurality of sleeve members are of at least two different lengths and are positioned along said shaft in selected fixed positions supporting selected ones of said second plurality of bearing races to establish said second selected fixed axially spaced relation thereof; and further including supporting means supported by said second plurality of sleeve members to resiliently support said second bearing race.

29. A downhole motor and bearing assembly according to claim 1 in which said second plurality of sleeve members are positioned between said shaft and said second plurality of bearing members.

30. A downhole motor and bearing assembly according to claim 10 in which said second plurality of sleeve members are positioned between said shaft and said second plurality of bearing members.

31. A downhole motor and bearing assembly according to claim 19 in which said second plurality of sleeve members are positioned between said shaft and said second plurality of bearing members.

32. A downhole motor and bearing assembly according to claim 24 in which said second plurality of sleeve members are positioned between said shaft and said second plurality of bearing members.

* * * * *